United States Patent [19]

Carter et al.

[11] Patent Number: 4,527,814

[45] Date of Patent: Jul. 9, 1985

[54] PROTECTIVE COVER FOR BOOKS

[75] Inventors: Leewood C. Carter; Robin P. Neary, both of Warren, N.J.

[73] Assignee: Book Covers Inc., Newark, N.J.

[21] Appl. No.: 397,476

[22] Filed: Jul. 12, 1982

[51] Int. Cl.[3] ..... B42D 3/00; B42D 3/02; B42D 3/04; B42C 11/00

[52] U.S. Cl. ..... 281/31; 281/34; 281/35; 281/19 R; 281/4; 412/3; 412/4; 412/5

[58] Field of Search ..... 281/4, 19 R, 29, 31, 281/35, 34; 412/3, 4, 5

[56] References Cited

U.S. PATENT DOCUMENTS

| | | | |
|---|---|---|---|
| 1,308,461 | 7/1919 | Walraven | 281/34 |
| 1,618,733 | 2/1927 | Sharrard | 281/34 |
| 3,017,201 | 1/1962 | Armson | 281/34 |
| 3,133,750 | 5/1964 | Gerald | 281/34 |
| 3,891,240 | 6/1975 | Du Corday | 281/29 |
| 4,274,659 | 6/1981 | D'Ambrosio | 281/31 X |
| 4,355,822 | 10/1982 | McHugh | 281/19 R X |

FOREIGN PATENT DOCUMENTS

| | | | |
|---|---|---|---|
| 1575014 | 9/1980 | United Kingdom | 281/31 |

*Primary Examiner*—Paul A. Bell
*Assistant Examiner*—Taylor J. Ross
*Attorney, Agent, or Firm*—Ezra Sutton

[57] ABSTRACT

The present invention relates to protective covers for books having two cover sections and pockets for receiving book covers, locking flaps for locking the protective covers to the book covers, an adjustable spine section to accommodate books of different thicknesses, and a tear-away strip to hold together the two cover sections until they are ready for use.

8 Claims, 9 Drawing Figures

PROTECTIVE COVER FOR BOOKS

FIELD OF THE INVENTION

The present invention relates to a novel product and method for protecting books and book covers, and more particularly is directed to a simple, inexpensive and efficient protective cover for books which is adjustable in size, so that it is adapted to accommodate books of different thicknesses, and also includes novel locking flaps for conveniently securing the protective cover to a book.

BACKGROUND OF THE INVENTION

It is presently known in the art to provide books, and especially paperback books, with covers that protect the books. Such protective covers commonly include front and back cover receiving pockets and body portions extending over the outer face of the book covers and over the spine of the book. Since books vary in thickness, protective covers are often made in different sizes, or are made to accommodate different book thicknesses. For example, reference is made to U.S. Pat. No. 3,891,240 which accommodates books of different thicknesses by having the spine section wrap around and extend in overlapping relationship, a back cover protector. However, such an arrangement leaves an unsightly seam on the protective cover which is visible to the user. In addition, no satisfactory arrangement is provided for preventing the book from inadvertently sliding out of the protective cover. Another representative prior art arrangement is found in U.S. Pat. No. 3,133,750 which includes a spine section which overlaps both the front and back cover protectors. Such an arrangement is also unsatisfactory in that it leaves an unsightly seam on both the front and back cover protectors.

Broadly, it is an object of the present invention to provide an improved protective cover for books, such as paperback books, which overcomes the aforesaid drawbacks. Specifically, it is within the contemplation of the present invention to provide an improved protective cover which is simple to use, inexpensive, and which accommodates books of different thicknesses.

It is a further object of the present invention to provide an improved protective cover which may be secured to the book to prevent it from being inadvertently removed from the protective cover and to prevent the book from moving relative to the protective cover, so that in use, the presence of the protective cover is substantially unnoticeable, and presents no inconvenience to the user.

SUMMARY OF THE INVENTION

Briefly, in accordance with the principles of the present invention, there is provided an improved protective cover which includes cover sections for each of the covers of the book to be protected, with each cover section including a pocket for receiving a book cover. In addition, each cover section is provided with a locking flap having double-sided adhesive tape applied thereto, so that each cover section can be secured to the book cover to prevent undesired movement between the cover sections and the book covers.

The protective cover of the present invention also includes a spine section affixed to the inside of the pocket of one of the cover sections and is also slidably received within the pocket of the other cover section to allow the spine section to be adjusted to accommodate books of different thicknesses.

In the preferred embodiment, the spine section is transparent to allow the title of the book to be legible. Also, in the preferred embodiment, the present invention is provided with a tear-away strip disposed between the two cover sections, so that when the protective cover is ready for use, the tear-away strip is removed and allows the two cover sections to be moved relative to each other. Advantageously, the tear-away strip keeps the two cover sections connected to each other during handling, storage, and shipping, so that the problems of handling a protective cover having two separate parts are totally avoided.

Advantageously, as a result of the present invention, an improved protective cover is provided which is simple to manufacture and use, is inexpensive and durable, easily accommodates books of different thicknesses, and because of the use of locking flaps, prevents undesired movement between the protective cover and book during use.

BRIEF DESCRIPTION OF THE DRAWINGS

Further objects, features, and advantages of the present invention will become apparent upon the consideration of the detailed description of the presently-preferred embodiments when taken in conjunction with the accompanying drawings, wherein.

DETAILED DESCRIPTION OF THE PREFERRED EMBODIMENTS

Figure 1:
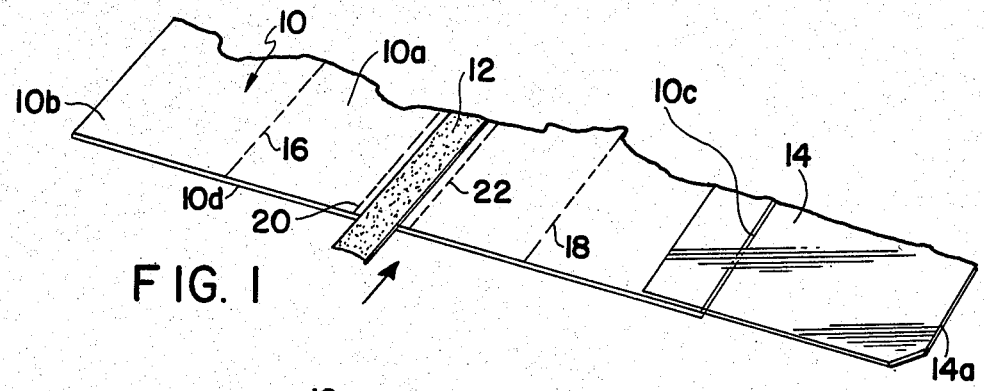
FIG. 1 is a perspective view showing the paperboard strip, transparent spine section, and adhesive tape during the method of manufacture.

Referring now to FIG. 1, there is illustrated one of the first steps in the method of manufacturing the improved protective cover of the present invention. A strip 10 of paperboard material is supplied from a roll or sheets of paperboard to a work station where a strip of double-sided adhesive tape 12 is applied to the surface 10*a* of the paperboard strip at approximately the central area thereof. Preferably, adhesive tape 12 is provided with a peel-away protective cover (not shown). The paperboard strip 10 includes longitudinally-extending edges 10*b* and 10*c* and is cut along its transversely-extending edges 10*d* and 10*e* in order to form a strip of paperboard material of the desired size and configuration.

As shown in FIG. 1, a strip 14 of transparent and flexible vinyl material is applied to the strip 10 of paperboard as it passes through the work station. The vinyl material 14 is applied along the longitudinal edge 10*c* and overlaps the upper surface 10*a* of the strip 10. The vinyl material 14 is suitably secured to paperboard strip 10 by adhesive or the like. It is also noted that any suitable flexible material may be used for strip 14, and also, in some cases, the strip 14 may be opaque and suitably labeled and/or decorated.

Figure 2:
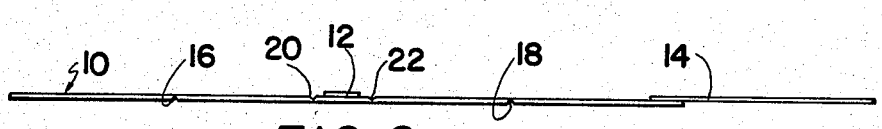
FIG. 2 is a side elevational view of the paperboard strip shown in FIG. 1.

As also seen in FIGS. 1 and 2, at the work station, the paperboard strip 10 is scored along lines 16, 18, so that the paperboard material may be folded over, as will be explained. In addition, the strip 10 is scored along lines 20, 22 to provide locking flaps therein, as will also be explained.

Figure 3:
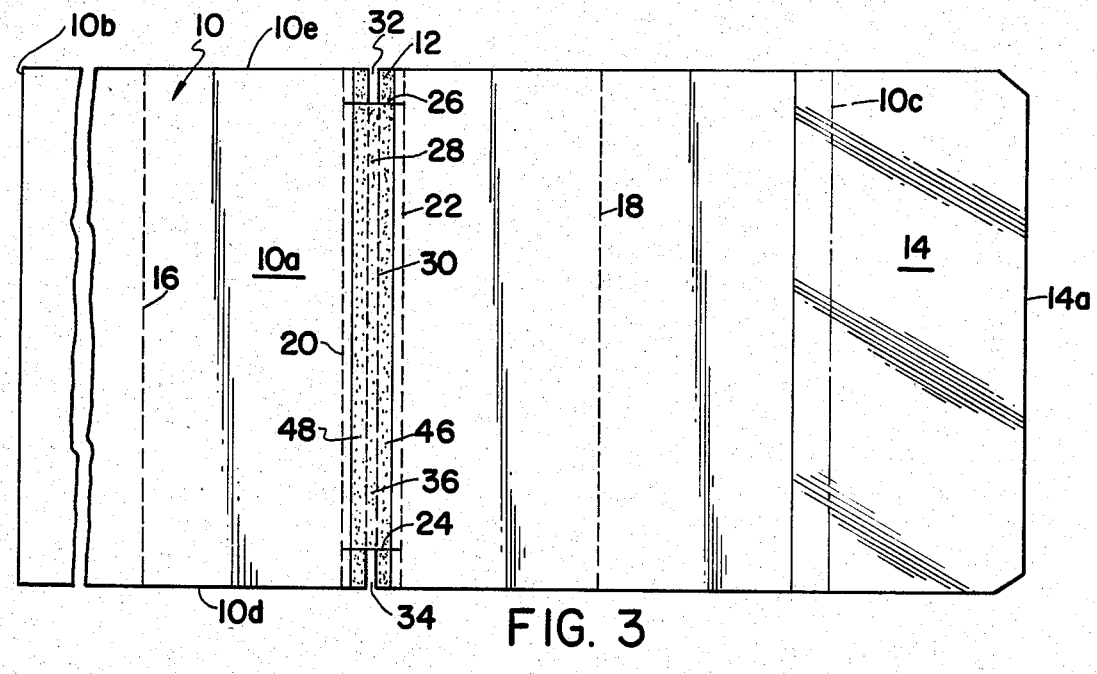
FIG. 3 is a top plan view of the paperboard strip spine section during manufacture.

As shown in FIG. 3, the strip 10 of paperboard material is supplied to the next work station where it is die cut. More particularly, strip 10 is die cut to form transversely-extending slits 24, 26 adjacent respective transversely-extending edges 10*d*, 10*e*. As will become apparent, this die cut operation is used to form locking flaps and a tear-away strip, as will be explained. In addition, as part of the die-cut operation, die cuts are made along lines 28, 30 which, in the preferred embodiment, are approximately one-eighth of an inch to one-quarter of an inch apart. As a result of these die-cut operations, two tabs fall away in the areas 32, 34. In addition, a tear-away strip 36 is formed between die-cut lines 28, 30, for a purpose to be explained. Locking flaps 46, 48 are also formed. Flap 46 is defined by lines 22, 30, 24, and 26, whereas flap 48 is defined by lines 20, 28, 24, and 26.

Figure 4:
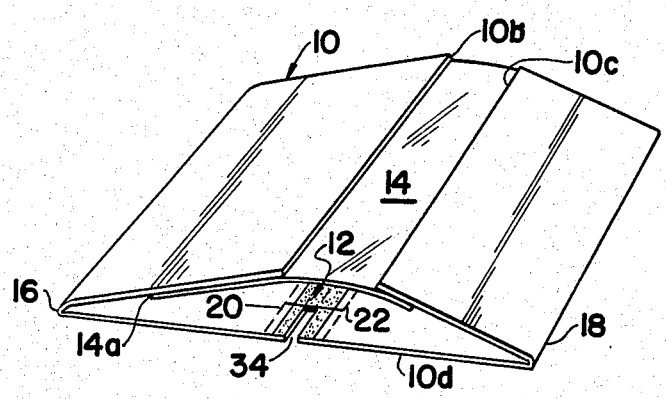
FIG. 4 is a perspective view illustrating the manner in which the paperboard strip and spine section are folded relative to each other during manufacture.
Figure 5:
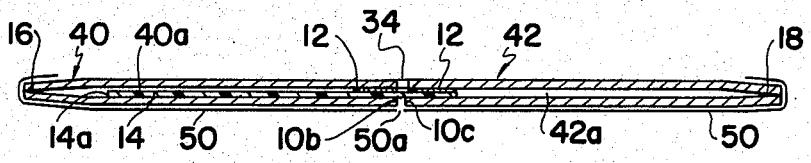
FIG. 5 is a cross-sectional view illustrating the paperboard strip after it has been case wrapped.

The strip 10 is then moved to the next work station, where the folding operation shown in FIG. 4 is performed. As shown in FIG. 4, the strip 10 is folded about score lines 16, 18, with end 14*a* of spine section 14 being folded inside the peperboard strip, as shown in FIG. 4. Once the folding operation is completed, it is important that longitudinal edges 10*b*, 10*c* do not overlap each other and come together approximately flush with each other, as shown in FIG. 5. As a result of this folding operation, two cover sections are formed, as shown in FIG. 5, one being designated as cover section 40, having a pocket 40*a*, and one being designated as cover section 42, having a pocket 42*a*.

Figure 6:
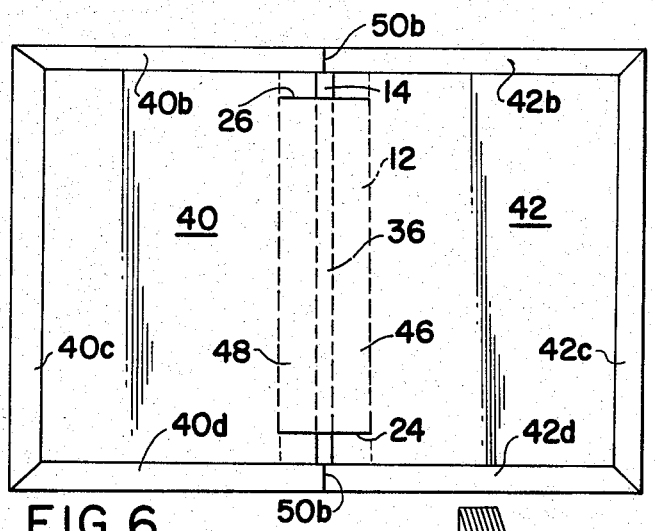
FIG. 6 is a top plan view of the paperboard strip after it has been die cut, folded, and case wrapped.
Figure 6A:
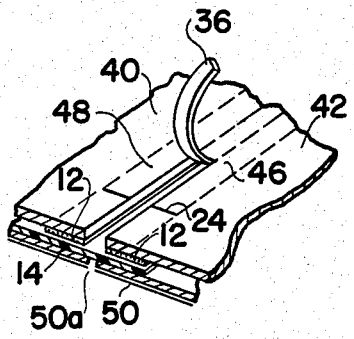
FIG. 6*a* is a detailed portion of FIG. 6 showing use of the tear-away strip.

The cover sections 40, 42 are then passed to the next work station where the edges are case wrapped, in a manner well known in the art. As shown in FIG. 5, the lower surfaces of cover sections 40, 42 are entirely covered with wrapping material 50 which is folded around score lines 16, 18 and adhered to the upper surfaces of cover sections 40, 42 along the peripheral edges. As shown more clearly in FIG. 6, the case-wrapped material 50 is adhered to the upper surface of cover section 40 about peripheral edges 40*b*, 40*c*, and 40*d* and is adhered to the upper surface of cover section 42 about peripheral edges 42*b*, 42*c*, and 42*d*. Referring again to FIG. 5, the lower surface of the case-wrapped material 50 is slit at 50*a*, and as shown in FIG. 6, the upper surface is also slit at 50*b*, so that the only thing holding together the two cover sections 40, 42 is the removable tear strip 36. Advantageously, the cover sections 40, 42 are kept together by tear strip 36 during handling, shipping, storage, and the like, and tear strip 36, as shown in FIG. 6*a*, is removed when the cover sections 40, 42 are ready for use and installation on a book.

Figure 7:
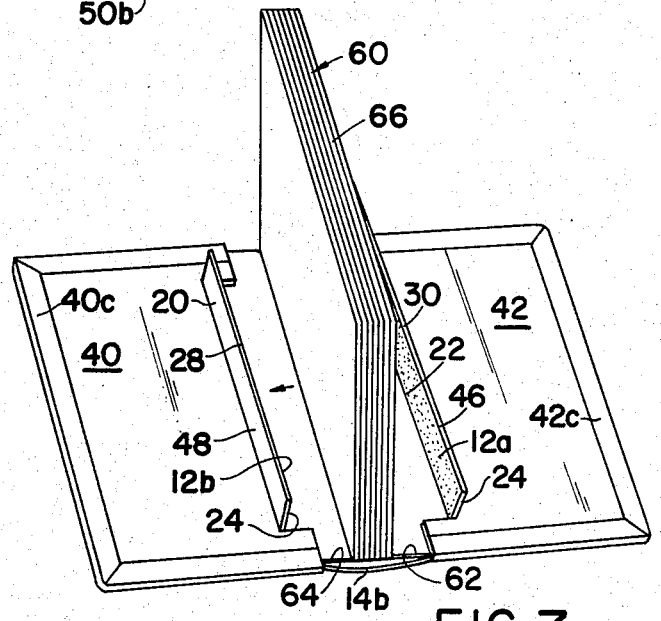
FIG. 7 is a perspective view of a book being installed into the protective cover of the present invention with the locking flaps not yet secured to the covers of the book.

Referring now to FIG. 7, the use of the cover sections 40, 42 and their installation on a suitable book 60 will now be explained.

Book 60 includes covers 62, 64 which are adapted to be inserted into cover sections 40, 42, respectively. As shown in FIG. 7, cover 62 is inserted into and is slid all the way into pocket 42*a* until the longitudinal edge of cover 62 reaches or comes close to the longitudinal outer edge 42*c*, and similarly, cover 64 is inserted into and slid all the way into pocket 40*a* until the longitudinal edge of cover 64 reaches or comes close to the longitudinal outer edge 40*c* of cover section 40. Depending on the thickness of the pages 66 of book 60, the cover sections 40, 42 are separated by a distance approximately equal to the thickness of pages 66. As a result, the spine section 14 has also been moved relative to cover section 40, so that the exposed spine section 14*b*, extending between the cover sections 40, 42, as shown in FIG. 7, accommodates the thickness of pages 66. As will be noted, since spine section 14 starts out substantially deep within pocket 40*a* of cover section 40, it can be moved relative to pocket 40*a* a substantial distance to accommodate books that are very thick. All that is required is that longitudinal edge 14*a* of spine section 14 remains inserted within pocket 40*a* a sufficient distance to prevent it from being inadvertently slid out of the pocket.

At this point in the installation, the user is then ready to adhere the locking flaps 46, 48 to the inside surfaces of book covers 62, 64, respectively. To accomplish this, the locking flaps 46, 48 are pivoted upwardly about respective score lines 22, 20, and a peel-away protective strip (not shown) covering the adhesive tape is torn away, leaving adhesive surface 12*a* of locking flap 46 exposed and leaving adhesive surface 12*b* of locking flap 48 exposed. Locking flaps 46, 48 are then pressed downwardly relative to the inner surfaces of book covers 62, 64, respectively. The book 60 and protective covers 40, 42 are now ready for use.

Advantageously, as a result of the present invention, the book 60, through its covers 62, 64, are securely attached to the cover sections 42, 40, so that the book cannot move relative to the cover sections. This avoids the problems of prior art arrangements wherein the cover sections were movable relative to the book and made use of the protective covers undesirable and inconvenient. Also, as a result of the present invention, no cutting and/or measuring or the like is necessary to accommodate the spine section 14 to books of different thicknesses, since by simply moving the cover sections 40, 42 relative to each other, the spine section 14 is automatically adjusted to the required size. Further, as a result of the present invention, the use of the tear-away strip 36 maintains the cover sections 40, 42 fixed relative to each other for handling, shipping, and storage until the user is ready to install the protective covers 40, 42 on a book.

Figure 8:
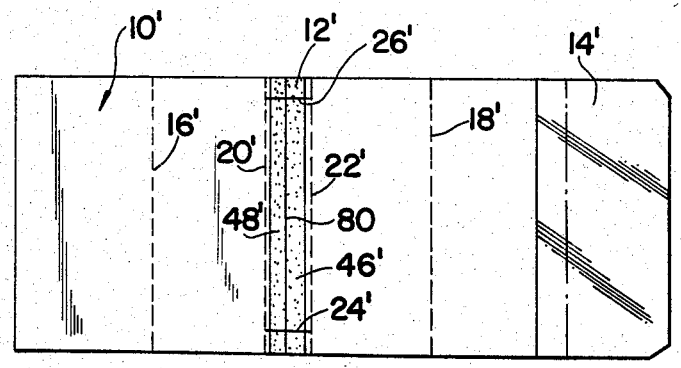
FIG. 8 is a plan view of an alternative embodiment of the present invention wherein the tear-away strip is not utilized.

Referring now to FIG. 8, there is shown an alternative embodiment of the present invention including strip 10′ of paperboard material, a strip of double-sided adhesive tape 12′, spine section 14′, score lines 16′, 18′, 20′, and 22′, die cuts 24′, 26′, and locking flaps 46′, 48′. In this embodiment, when the central area of the strip 10′ is die cut, a single cut 80 down the center is made to separate strip 10′ into two parts. This is the only difference between the embodiment of FIG. 8 and the embodiment of FIGS. 1 through 7 wherein tear strip 36 is formed by die cuts 28, 30.

In the embodiment of FIG. 8, the strip 10' is folded over, as shown in FIG. 4, to form two cover sections, and as shown at FIGS. 5 and 6, the two cover sections are case wrapped, as explained above. Accordingly, in this embodiment, the locking flap 46' is defined by edges 22' and 80, whereas locking flap 48' is defined by edges 20' and 80. Further, in this embodiment, when the covers are ready for use, there is no tear-away strip to be removed, as shown in FIG. 6*a*. All that is necessary is that the book be inserted within the respective pockets, as explained above, and the locking flaps 46', 48' are adhered to the inner surfaces of the covers of the book.

Accordingly, the embodiment of FIG. 8 accomplishes all of the functions and purposes described above, except that without the tear strip, the two cover sections are free to move relative to each other. Accordingly, this embodiment is useful when there is not a concern with regard to movement during handling, storage, shipping, and the like.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A protective cover for a book having first and second book covers, comprising:

a first cover section defining a first pocket having a first pocket opening for receiving said first book cover, said first cover section including two superimposed strips of paperboard material having four edges, three of said edges being affixed to each other and said fourth edge being opened to define said first pocket opening, and first locking means formed on the inside of said first cover section adjacent said first pocket opening;

a second cover section defining a second pocket having a second pocket opening for receiving said second book cover, said second cover section including two superimposed strips of paperboard material having four edges, three of said edges being affixed to each other and said fourth edge being opened to define said second pocket opening, and second locking means formed on the inside of said second cover section adjacent said second pocket opening;

a spine section affixed to said first cover section and slidably received within the pocket of said second cover section for adjusting said spine section to the size of said book being covered to form a spine area between said first and second cover sections; and said first and second locking means operable to be fastened to a book being covered and thereby prevent said first and second cover sections from separating from each other.

2. A protective cover in accordance with claim 1 wherein said spine section is transparent and adjustable in size by moving said spine section relative to said second cover section to form said spine area.

3. A protective cover in accordance with claim 2 wherein said spine section is affixed to the inside of said first cover section.

4. A protective cover in accordance with claim 1 wherein said first locking means includes a first locking flap having adhesive contained thereon for adhering said first locking flap to the surface of said first book cover which is being covered by said protective cover.

5. A protective cover in accordance with claim 1 wherein said second locking means includes a second locking flap having adhesive contained thereon for adhering said second locking flap to the surface of said second book cover which is being covered by said protective cover.

6. A protective cover in accordance with claim 1 further including means for detachably connecting said first and second cover sections.

7. A protective cover in accordance with claim 6 wherein said detachably connecting means includes a tear-away strip disposed between said first and second cover sections.

8. A protective cover in accordance with claim 1 wherein said three edges of said first cover section are affixed to each other by wrapping said three edges with a covering material, and wherein said three edges of said second cover section are affixed to each other by wrapping said three edges with a covering material.

* * * * *